United States Patent [19]

Hirose

[11] 4,355,711

[45] Oct. 26, 1982

[54] BANK NOTE DEPOSITING DEVICE FOR A TRANSACTION MACHINE

[75] Inventor: Minoru Hirose, Yokohama, Japan

[73] Assignee: Tokyo Shibaura Denki Kabushiki Kaisha, Kawasaki, Japan

[21] Appl. No.: 147,281

[22] Filed: May 6, 1980

[30] Foreign Application Priority Data

May 15, 1979 [JP] Japan ..... 54-59299

[51] Int. Cl.[3] ..... G07F 7/04

[52] U.S. Cl. ..... 194/4 C

[58] Field of Search ..... 194/4 C, DIG. 9, DIG. 26, 194/4 R, 4 B, 4 D, 4 E; 235/61.11; 221/9, 259

[56] References Cited

U.S. PATENT DOCUMENTS

| | | | |
|---|---|---|---|
| 3,211,268 | 10/1965 | Dills et al. | 194/4 |
| 3,783,989 | 1/1974 | Jensen | 194/4 |
| 4,023,011 | 5/1977 | Nakajima et al. | 194/4 X |
| 4,283,708 | 8/1981 | Lee | 194/4 X |

*Primary Examiner*—Stanley H. Tollberg

*Attorney, Agent, or Firm*—Schuyler, Banner, Birch, McKie & Beckett

[57] ABSTRACT

A bank note depositing device for a transaction machine comprises a cabinet having a depositing inlet through which at least one bank note is deposited into the transaction machine, a storing pocket positioned within the cabinet and adjacent the depositing inlet for temporarily storing the bank notes entering the machine through the depositing inlet, the storing pocket having an outlet through which the notes are discharged, a discharge roller for discharging the notes from the storing pocket, the discharge roller movable between a retracted position out of contact with the notes and an extended discharging position in contact with the notes, a support member positioned opposite the discharge roller on the opposite side of the notes, the support member movable between a retracted position away from the discharge roller and an extended discharge position toward the discharge roller to urge the notes into contact with the discharge roller.

13 Claims, 8 Drawing Figures

FIG. 3
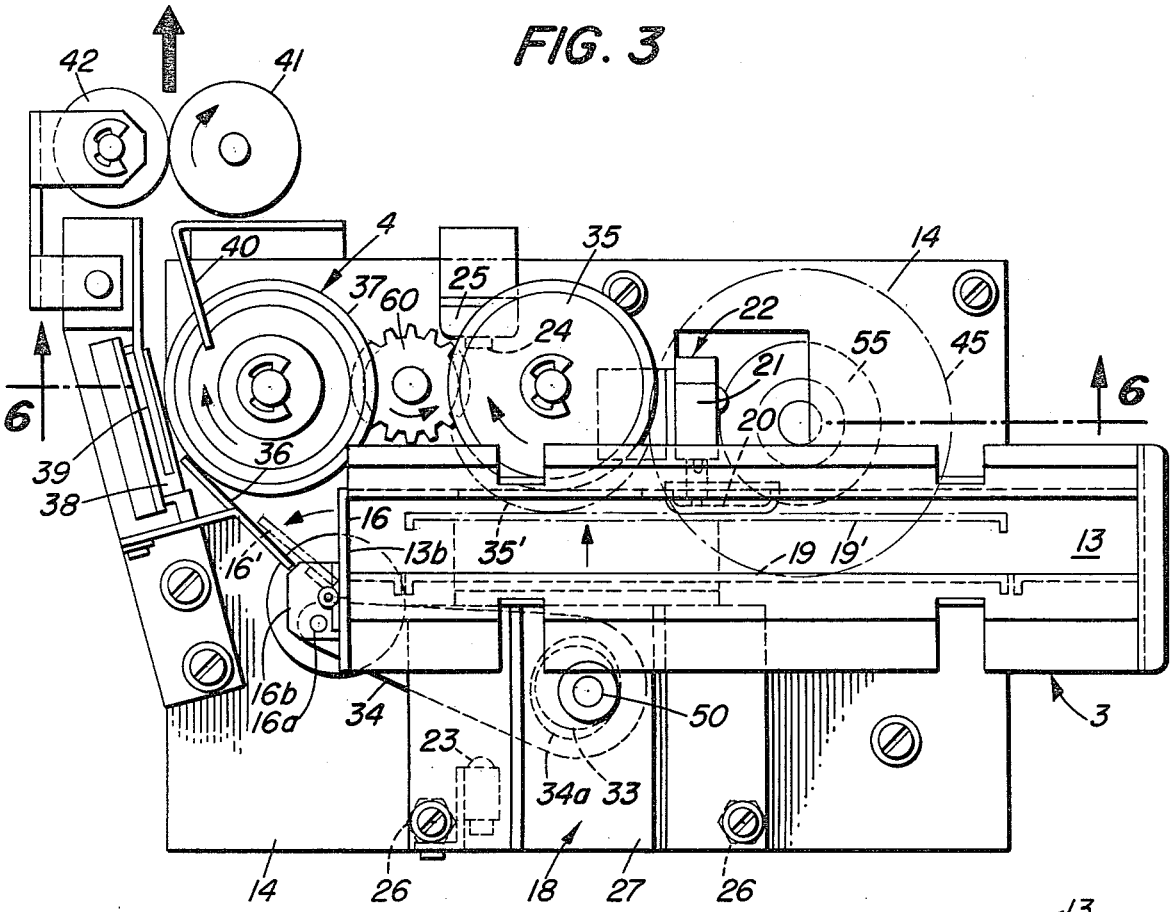
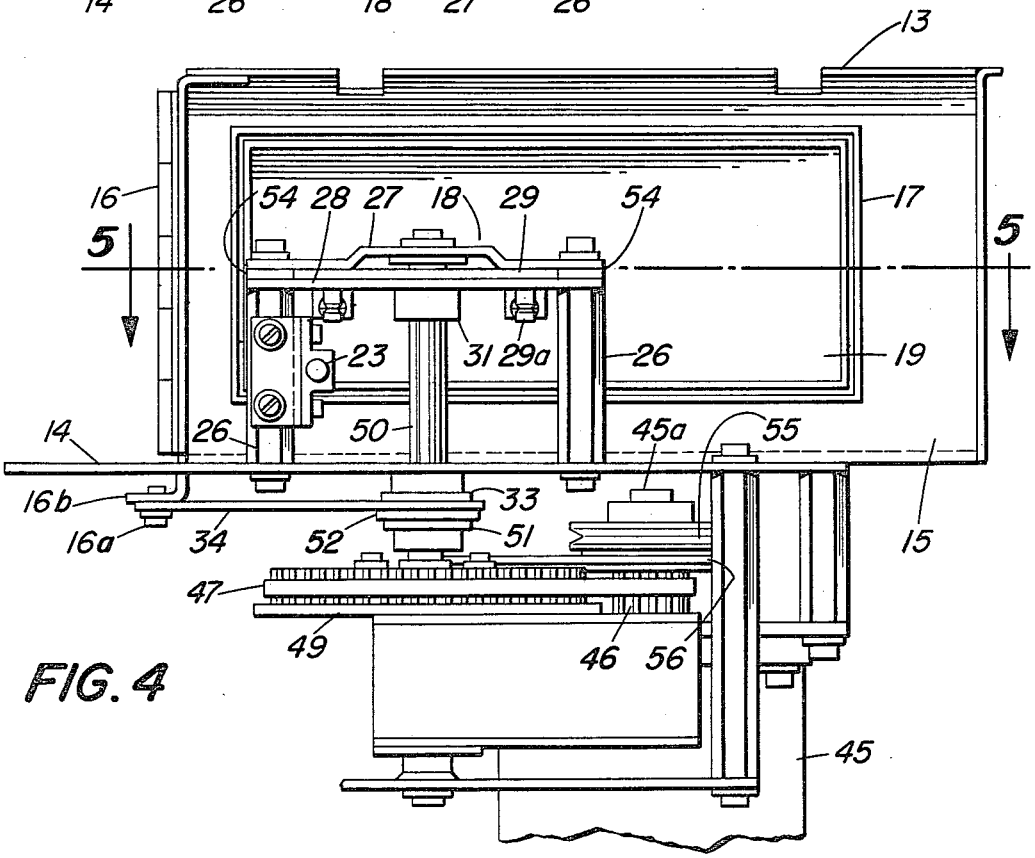
FIG. 4

BANK NOTE DEPOSITING DEVICE FOR A TRANSACTION MACHINE

BACKGROUND OF THE INVENTION

This invention relates to a bank note depositing device which can, for example, be used in the lobby of a bank to permit customers the opportunity to perform banking transactions without the aid of tellers. Such devices permit the depositing of bank notes, the transferring funds and the issuing of cash. Automatic depositing machines and cash dispensing machines have recently been developed to reduce the necessary labor in performing banking transactions. In general, transaction machines can consist of a depositing machine, a dispensing machine, or a depositing and dispensing machine.

In the conventional depositing machine (see e.g., U.S. Pat. No. 4,023,011), a customer deposits several bank notes into a depositing device; each note is then withdrawn by a suction device and transferred to a sensing section for judging its genuineness. As a result, a suction pump must be provided within the machine to perform this operation. Consequently, the size of the machine must necessarily be increased to accommodate this structure. Moreover, the power supplied to the machine must be increased to meet the additional power demands of the suction pump. Further, the concomitant noise produced by the suction pump makes its use impractical and undesirable.

Furthermore, in the conventional depositing machine, the opening inlet of the depositing device permits access and viewing of its internal structure. Consequently, a vandal can easily reach internal parts of the machine to alter or jam its operation.

SUMMARY OF THE INVENTION

It is an object of the present invention to provide a bank note depositing device overcoming the disadvantages of the conventional machine by utilizing a simpler structure.

It is a further object of the present invention to provide a transaction machine having a compact size.

It is a further object of the present invention to provide a transaction machine wherein power consumption is reduced.

A still further object of the invention is to provide a transaction machine wherein operational noise is reduced.

A still further object of the invention is to provide a transaction machine which precludes easy access into its internal parts by vandals.

BRIEF DESCRIPTION OF THE DRAWINGS

FIG. 3 is a plan view of the storing means and discharging means taken along line 3—3 of FIG. 2;

FIG. 4 is a elevational view of the assembly shown in FIGS. 2 and 3 taken along line 4—4 of FIG. 2;

DETAILED DESCRIPTION OF THE PREFERRED EMBODIMENT

Figure 1:
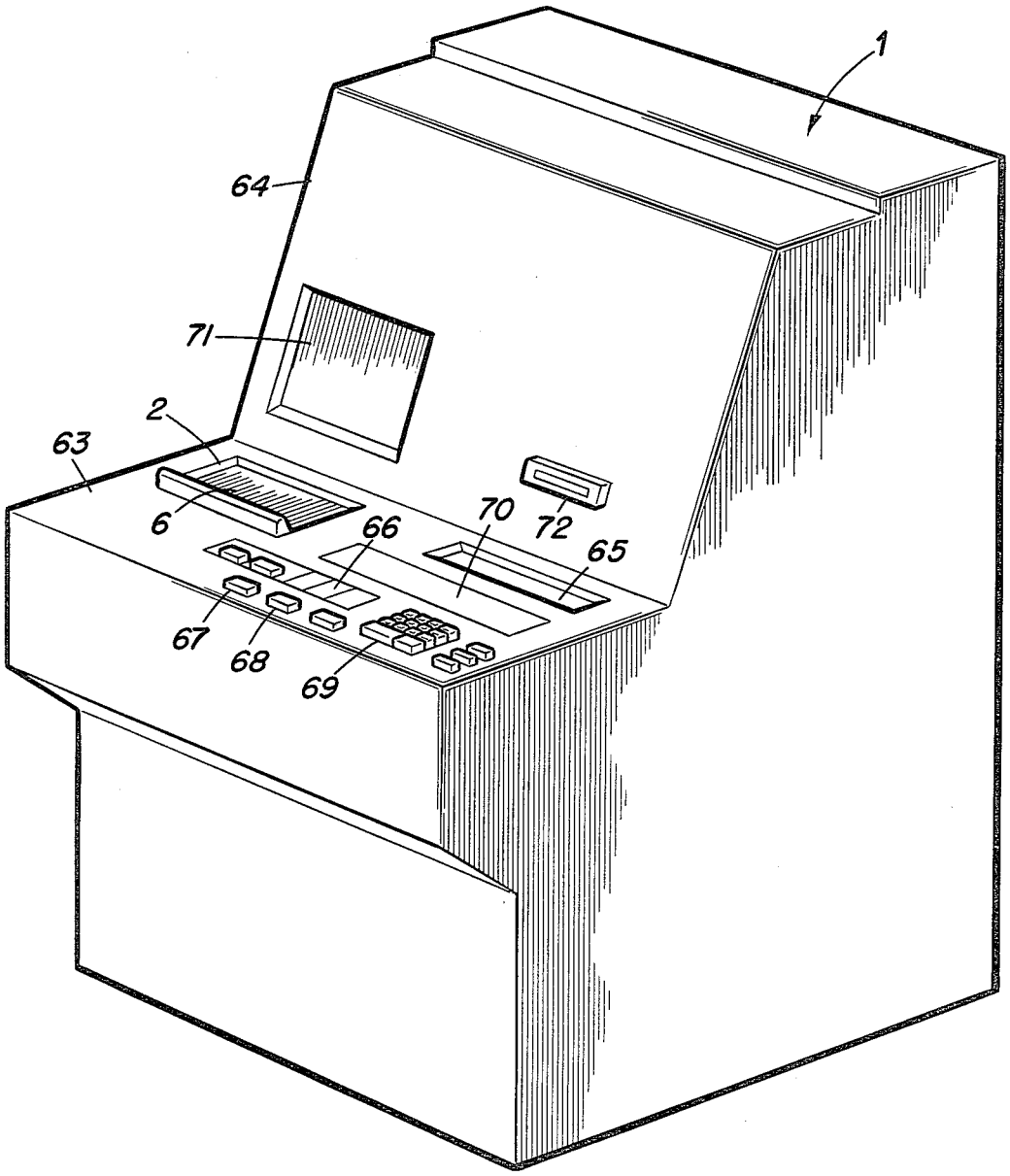
FIG. 1 is a front perspective view of a transaction machine having a bank note depositing device according to this invention.

The exterior of a transaction machine having a bank note depositing device according to this invention is shown in FIG. 1. The machine includes a horizontal control panel surface 63 on the front side of a cabinet 1 and a control panel 64 extending upwardly from the rear edge of panel surface 63. Horizontal control panel surface 63 is provided with a depositing inlet 2 for depositing bank notes and an inlet slot 65, adjacent inlet 2, for depositing a passbook. Inlet 2 contains a cover 6 slidably movable between an opened and closed position. On panel surface 63 there is provided a display section 66 for displaying the amount of bank notes which have been deposited in inlet slot 2. The panel surface 63 also includes the following: a transaction approval key 67 for use by the customer when the amounts displayed are approved by the customer; a disapproved key 68 for use by the customer when the amounts displayed are disapproved by the customer; ten-keys 69 for inputting the desired amount to be dispensed; and, a display section 70 to inform customers of the transaction stage being performed by the machine. Also shown are a paying outlet 71 and an I.D. card inlet slot 72 which are adjacently positioned on panel surface 64.

Figure 2:
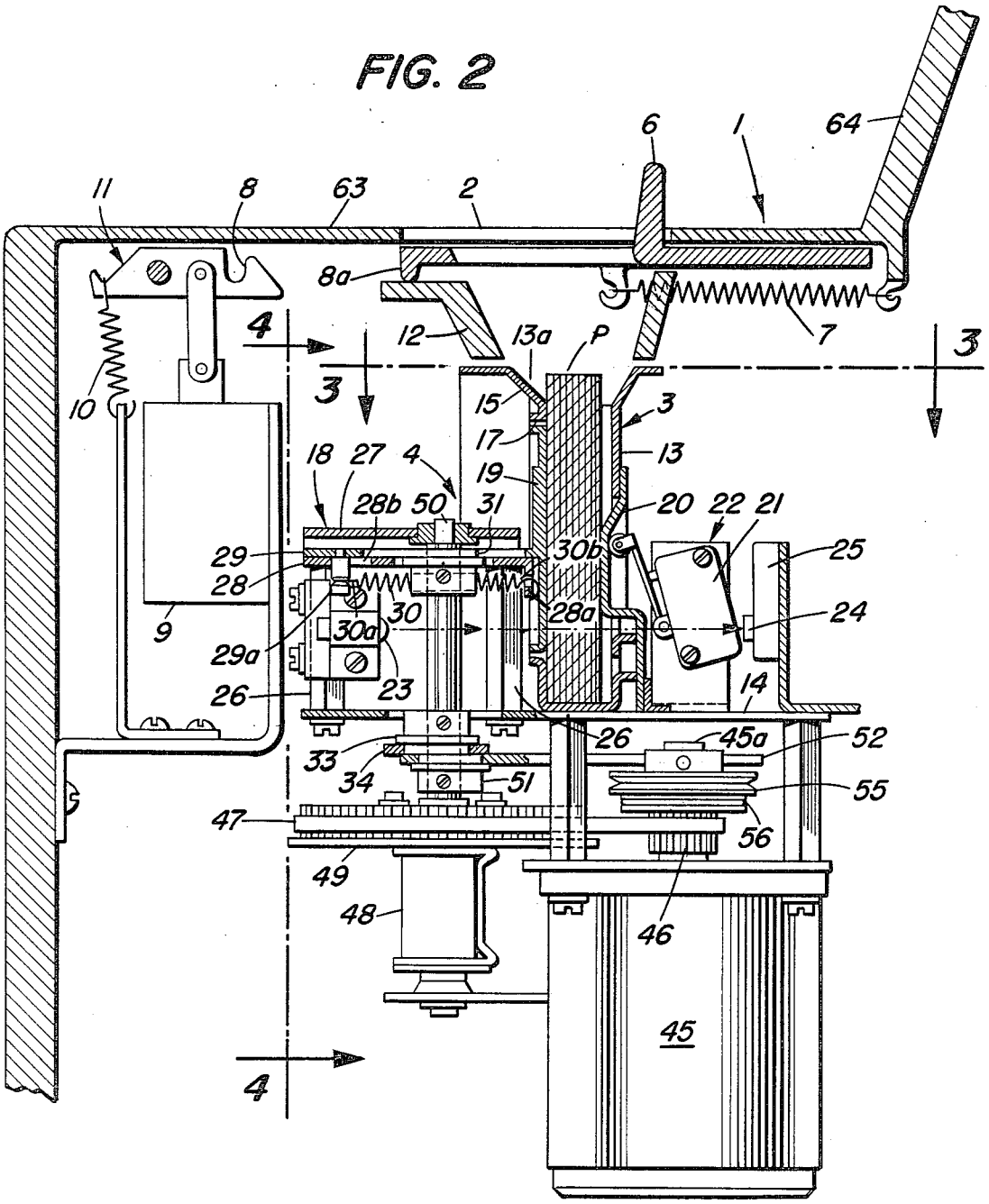
FIG. 2 is an enlarged vertical sectional view of the device showing the storing means and discharging means (with some parts omitted for the sake of clarity)

As shown in FIG. 2, positioned directly below inlet 2 are a storing mechanism 3 and a discharge mechanism 4. Storing mechanism 3 is utilized for receiving several bank notes P which are deposited into the machine from depositing inlet 2. Discharge mechanism 4 is utilized for causing bank notes P to be successively discharged from the storing mechanism 3. The discharged notes are then transferred to a sensing section, as known in the prior art (see e.g., U.S. Pat. No. 4,023,011), for judging their genuineness.

Depositing inlet 2 contains a slidably movable cover 6 for opening or closing inlet 2. Cover 6 can be maintained in either an opened position by spring 7 or a closed position by a locking mechanism 11. As shown in FIG. 2, spring 7 urges cover 6 in the direction of panel 64 to permit the depositing of notes through inlet 2. Locking mechanism 11 includes a latch 8 for temporarily locking the cover 6 in a closed position by engaging flange 8*a* on cover 6, a solenoid 9 for forcing latch 8 to a downward position to release cover 6, and a spring 10 for returning latch 8 to its upward position.

A bank note insert guide member 12 is positioned directly below inlet 2 for guiding the notes into storing mechanism 3. Storing mechanism 3 includes a depositing pocket 13 disposed immediately below guide member 12, for permitting the several bank notes P deposited through inlet 2 to be positioned and held in an erect manner. As shown in FIGS. 2 and 3, depositing pocket 13 consists of a body 15 which has a box-like configuration; body 15 is secured to the upper side of a mounting board 14 horizontally disposed within cabinet 1. Box-like body 15 includes an opening 13*a* at its upper portion for entry of the notes within pocket 13, and further includes a door member 16 for opening and closing an outlet 13*b*. As shown in FIGS. 2 and 4, box-like body 15 contains along its front side a window 17. Positioned within window 17 is a support member 19 which is capable of moving from a retracted position, flush with the front side of body 15, to an extended position (19'—FIG. 5) within body 15 in the direction of its rear side. Movement of support member 19 is produced by a supporting mechanism 18, which will be described below. Upon activation of supporting mechanism 18, support member 19 will be moved inwardly; as a result, notes P, deposited within pocket 13, will be urged with an appropriate force toward the rear side of body 15. In this way, the notes will be held erect in a neat and orderly manner within pocket 13.

FIGS. 2–3 show a detecting mechanism 22 which detects the presence of an excessive amount of bank notes within pocket 13. Detecting mechanism 22 comprises a detector link 20 which extends within body 15 at its rear portion, and a microswitch 21 coupled to detector link 20 for detecting its movement. As shown in FIG. 2, the lower end of detector link 20 is connected to mounting board 14 to permit limited pivotal movements of its upper end. When an excessive amount of notes are placed within pocket 13, the upper portion of detector link 20 will be urged outwardly by the force of the notes. In that event, detector link 20 will contact microswitch 21 to turn it on. Upon the operation of detecting mechanism 22, the bank notes P will not be discharged from outlet 13*b* of pocket 13 for further processing. Furthermore, the display section 70 (FIG. 1) will be activated to inform the customer of the presence of an excessive amount of notes; in such a case, the customer will have to remove the notes and then deposit a lesser amount.

FIGS. 2–4 show a further detecting mechanism 25 for sensing the presence of notes P within pocket 13. This mechanism comprises a light source 23 and a photosensitive element 24. The light generated by source 23 passes through aligned holes (not shown) in the front and rear of body 15. In the absence of notes P within pocket 13, the light beam is not interrupted and is thereby sensed by element 24. An output from element 24 indicates that all of the notes within pocket 13 have been discharged through outlet 13*b* and the discharge operation is then terminated.

Figure 5:
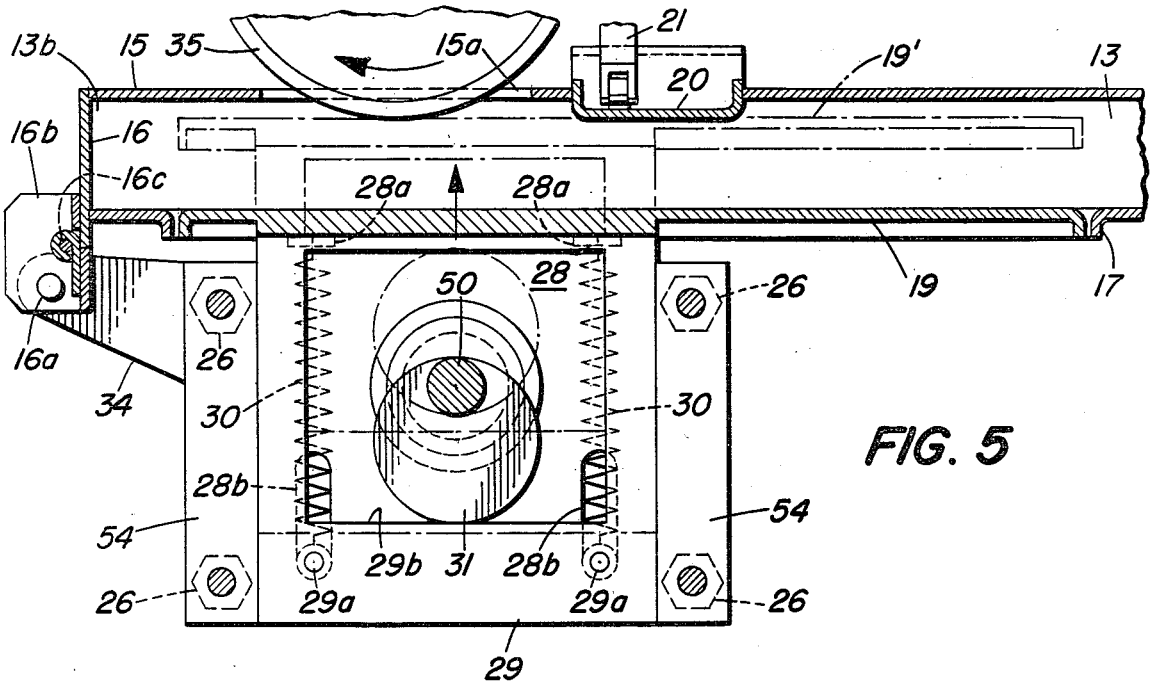
FIG. 5 is a horizontal sectional view of the support mechanism taken along line 5—5 of FIG. 4.

The support mechanism 18 for moving support member 19 between a retracted position to an extended position in contact with notes P has the following construction. As shown in FIGS. 2, 4 and 5, support member 19 is connected to a movable plate 29. Plate 29 is movable in a channel formed between a horizontally oriented upper guide plate 27 and a horizontally oriented lower guide plate 28. As shown in FIGS. 4–5, guide plates 27 and 28 are maintained in a spaced relationship by two spacer rails 54, each being oriented parallel to the direction of movement of plate 29. Each rail 54 is coplanar to plate 29 and is positioned adjacent a respective side edge of plate 29. As a result, plate 29 is permitted to move along only a single directional axis; that is, plate 29 can move from a retracted position to an extended position whereby it contacts notes P within pocket 13. Plates 27, 28 and rails 54 are maintained in position by four vertical supporting posts 26. Two of the posts are connected at their upper end along one side of the plates 27, 28 while the remaining posts are connected along the opposite side of the plates 27, 28. The lower ends of the posts 26 are connected to mounting board 14.

As shown in FIGS. 2 and 5, two spaced pins 29*a* are secured to the rear end of plate 29, and oriented downwardly through elongated slots 28*b* formed in the rear portion of lower guide plate 28. Slots 28*b* are elongated along the single directional axis of plate 29 to permit limited movement of the plate. Two spaced downwardly oriented tabs 28*a* are formed at the end of guide plate 28 nearest support member 19. A spring 30 is provided between the lower end of each pin 29*a* and its corresponding tab 28*a*. The rear end 30*a* of each spring 30 is connected to an annular groove at the lower end of pin 29*a*; its front end 30*b* is connected to the tab 28*a*. As a result, movable plate 29 integral with support member 19 is biased in the forward direction such that it extends into pocket 13 (i.e., extended position). When notes P are not within pocket 13, however, movable plate 29 is forced in the rearward direction (i.e., retracted position) by a circular cam 31 secured to a shaft 50 of an intermittent clutch 48. As shown in FIG. 5, cam 31 is positioned within a square opening 29*b* of movable plate 29. When intermittent clutch 48 is activated, cam 31 is rotated one half rotation. As a result, movable plate 29 is moved by cam 31 from a retracted position to an extended position and support plate 19 will thereby push notes P further within pocket 13.

FIGS. 2–4, 6 and 7 show door member 16 for closing and opening outlet 13*b* of pocket 13. As shown in FIG. 3, a metal link 34 is formed having an elliptical opening 34*a* at one of its ends. The other end of link 34 is pivotally connected to a flange 16*b* integral with door 16 through a connecting pin 16*a*. A circular cam 33 is positioned within elliptically opening 34*a* and connected to the output shaft 50 of clutch 48. During the half rotation of cam 33, link 34 is moved along its axis so that door member 16 moves between an opened and closed position about hinge pin 16*c* (as shown in FIG. 3, broken line 16' indicates the open position of the door).

Figure 6:
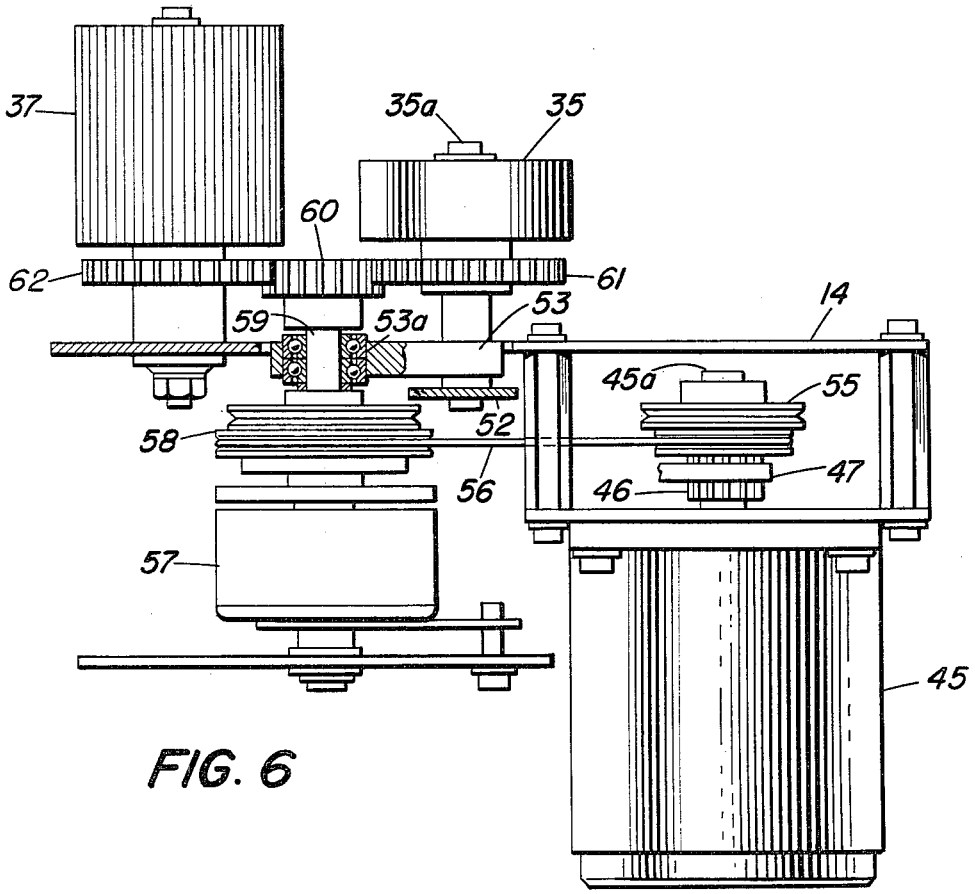
FIG. 6 is a vertical sectional view of the roller driving mechanism (with some parts omitted for the sake of clarity) taken along line 6—6 of FIG. 3.
Figure 7:
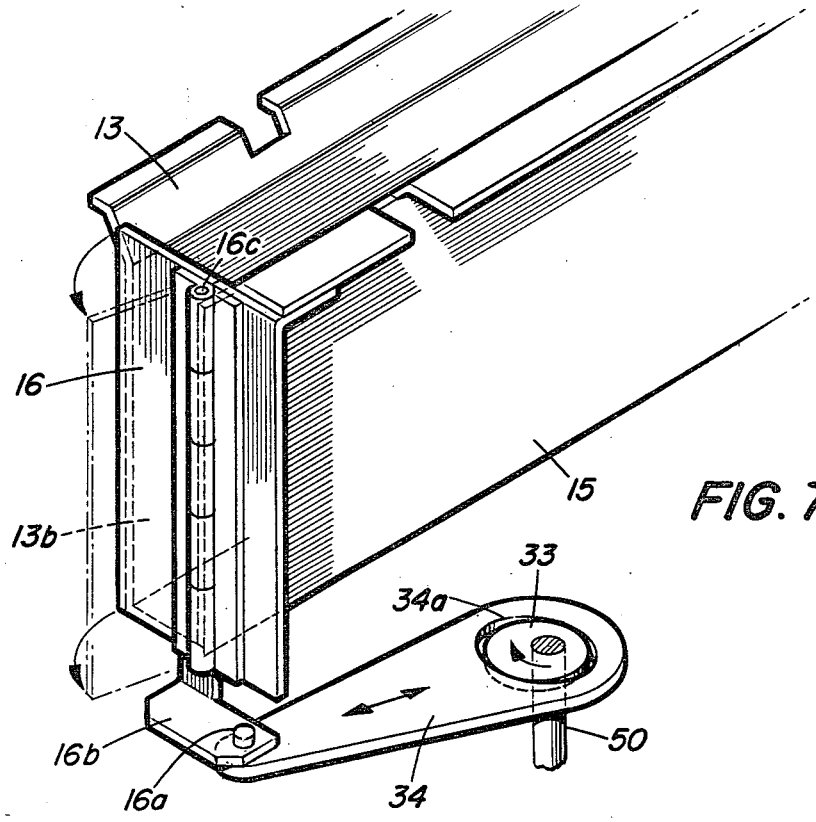
FIG. 7 is a perspective view of the depositing pocket and the mechanism for opening and closing the door at the discharge opening of the pocket.
Figure 8:
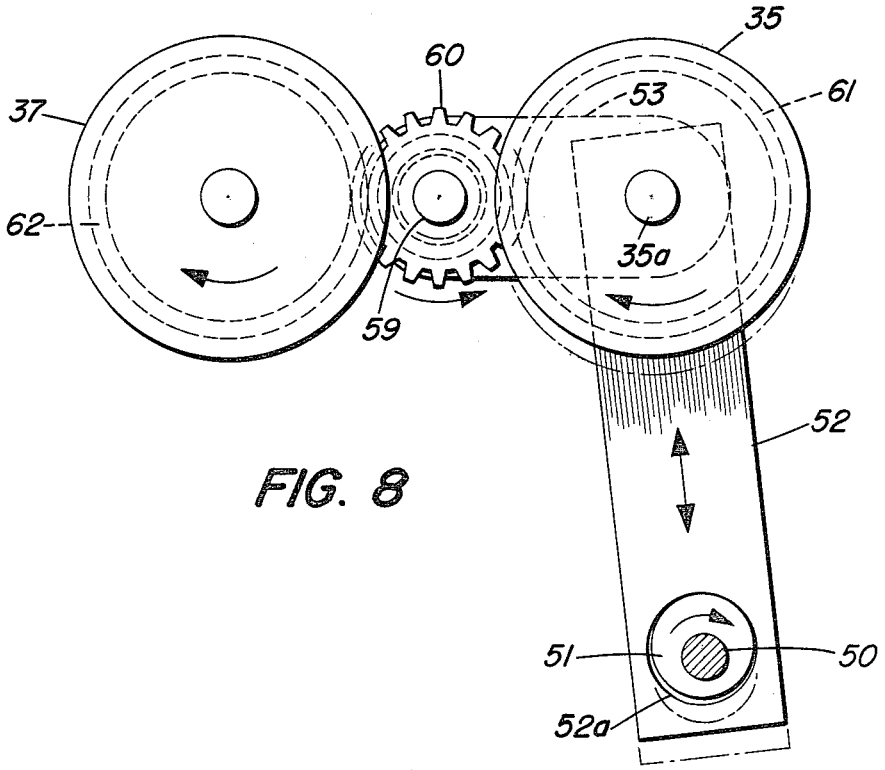
FIG. 8 is a plan view of the mechanism for moving the discharge roller into engagement with the deposited documents.

FIGS. 2–4, 6 and 8 show discharge mechanism 4 for discharging notes P within pocket 15. The notes are discharged by a discharge roller 35 and then supplied to a feed roller 37, where they are then supplied to transporting/pinch rollers 41 and 42. Roller 35 is moved from a retracted position outside pocket 13 to an extended position inside pocket 13 in contact with notes P. As shown in FIG. 6, roller 35 is connected at one end of shaft 35*a*; the other end of shaft 35*a* is mounted on arm 53 and connected to metal link 52 which provides the retracting and extending movement of roller 35, as will be discussed below. One end of swing arm 53 supports shaft 35*a*, and its other end is freely pivotable about a shaft 59 which rotates in a roller bearing 53*a*. Shaft 59 is directly connected to a clutch 57 which is driven by belt 56 from motor 45 and provides drive to discharge roller 35 and feed roller 37 through gears 60, 61 and 62. The other end of link 52 contains a circular opening 52*a*. Circular opening 52*a* is operatively coupled with a circular cam 51 secured to output shaft 50 of clutch 48. Upon activation of clutch 48, roller 35 is caused to move from a retracted position to an extended position (as shown in FIG. 3, broken line 35') within pocket 13. Roller 35 extends into pocket 13 through a rectangular opening 15*a* in body 15.

When a customer deposits bank notes P into pocket 13 and then closes cover 6, a detector (e.g., microswitch—not shown), as known in the prior art (See e.g., U.S. Pat. No. 4,023,011), is activated. The detector then actuates a motor 45. As shown in FIG. 2, the drive force of motor 45 is then transmitted to intermittent clutch 48. The force is transmitted via a timing pulley 46 mounted on a motor shaft 45*a* and a timing belt 47 to a timing pulley 49 on the input side of intermittent clutch 48. Intermittent clutch 48 is responsive to a pulse signal (not shown) for converting continuous rotary motion to intermittent rotary motion of a predetermined angular magnitude. That is, as soon as shaft 45*a* begins to rotate, the pulse signal is produced from a control section (not shown) to cause a singular 180 degree rotation of output shaft 50. As a result of the 180 degree rotation of shaft 50, cams 51, 33 and 31 each secured along output shaft 50, will be rotated by one half rotation with output shaft 50. This rotation of cam 51 causes movement of link 52 which in turn, urges roller 35 to move about shaft 59. As a result, roller 35 is urged to an extended position partly within pocket 13, as shown by broken lines 35' (FIG. 3). The simultaneous rotation of cam 33 causes movement of link 34 which, in turn, urges door member 16 of pocket 13 to an opened position, as shown by broken lines 16' (in FIG. 3). Finally, the simultaneous rotation of cam 31 permits movement of movable plate 29 which in turn, urges support member 19 to a horizontally extended position partially within pocket 13, as shown by broken lines 19' (FIGS. 3, 5). As shown in FIGS. 2 and 5, the biasing of springs 30 force movable plate 29 into the extended position. This serves to urge bank notes P against discharge roller 35, which is also extended. The biasing force of springs 30 are set to an optimum value necessary for roller 35 to effectively discharge the notes through outlet 13*b*. An excessive biasing force, on the other hand, would produce the simultaneous discharge of a plurality of bank notes which could jam the machine.

When support member 19 and roller 35 are moved to their respective positions within pocket 13, the bank notes are successively discharged by roller 35 through outlet 13*b*. Each discharged note then contacts feed roller 37 which feeds the notes to a process, as known in the prior art, for judging their genuineness. More particularly, the driving force for rollers 35 and 37 are as follows. As shown in FIG. 6, motor 45 transmits torque via a belt 56 from a pulley 55 secured to motor shaft 45*a* to a pulley 58 on the input side of clutch 57. When a signal is supplied to clutch 57 from a control section (not shown), clutch 57 is activated and gear 60, secured to output shaft 59, will then rotate. Gear 60 transmits torque from output shaft 59 to gears 61 and 62. As a result, rollers 35 and 37 connected to respective gears 61 and 62 will also rotate; discharge roller 35 and feed roller 37 will rotate in the direction of the arrows shown in FIG. 3. Discharge roller 35 successively forces each bank note P, positioned within pocket 13, toward feed roller 37. Each note P will then contact guide member 36 which will direct the note in the direction of roller 37. The notes will then move between a friction plate 38, positioned adjacent roller 37, and roller 37. In addition to guiding the notes, friction plate 38 will separate a plurality of bank notes P in the event they have been collectively transferred by roller 35. During the intermittent operation of clutch 57, the notes are successively moved from pocket 13 to roller 37. The notes are then guided between guide members 39 and 40 and transferred one after another through transporting-/pinch rollers 41, 42 (see FIG. 3). The notes are then transferred from rollers 41 and 42 to a sensing section (not shown), as known in the prior art, for judging their genuineness.

When all the notes have been discharged, a detecting mechanism 25 is activated, as discussed previously. In that event, intermittent clutch 48 is activated to cause a further one half rotation of cams 33, 51 and 31. As a result, door member 16 is closed and discharge roller 35 and support member 19 are moved from their extended position within pocket 13 to a retracted position. When roller 35 and support member 19 are in their retracted position, the only internal parts of the machine which are visible is depositing pocket 13 as a result, the depositing machine is protected since the other internal mechanisms are neither viewable nor accessible through depositing inlet 2.

I claim:

1. A bank note depositing device for a transaction machine comprising:

a cabinet having a depositing inlet through which at least one bank note is deposited into said transaction machine;

a storing means positioned within said cabinet and adjacent said depositing inlet for temporarily storing the bank notes entering said machine through said depositing inlet, said storing means having an oulet through which said notes are discharged;

a discharge roller means for discharging the notes from said storing means, said discharge roller means movable between a retracted position our of contact with said notes and an extended discharging position in contact with said notes;

a support member positioned opposite said roller means on the opposite side of said notes, said support member movable between a retracted position away from said discharge roller means and an extended discharge position toward said roller means to urge said notes into contact with said roller means; and, said storing means comprising a closure means positioned adjacent said outlet for opening and closing said outlet.

2. The bank note depositing device of claim 1 wherein said roller means consists of a friction roller.

3. The bank note depositing device of claim 1 wherein said closure means comprises a door member movable between a first position closing said outlet, and a second position opening said outlet for permitting the notes to be discharged from said storing means.

4. The bank note depositing device of claim 1 further comprising a detecting means for detecting the presence of an excessive amount of bank notes within said storing means.

5. The bank note depositing device of claim 1 wherein said discharge roller means while in said extended position successively discharges said notes through said outlet.

6. A bank note depositing device for a transaction machine comprising:

a cabinet having a depositing inlet through which at least one bank note is deposited into said transaction machine;

a storing means positioned within said cabinet and adjacent said depositing inlet for temporarily storing the bank notes entering said machine through said depositing inlet, said storing means having an outlet through which said notes are discharged;

a discharge roller means for discharging the notes from said storing means, said discharge roller means movable between a retracted position out of contact with said notes and an extended discharging position in contact with said notes; and, a support member positioned opposite said roller means on the opposite side of said notes, said support member movable between a retracted position away from said discharge roller means and an extended discharge position toward said roller means to urge said notes into contact with said roller means;

an intermittent clutch means including a shaft connected thereto for rotating said shaft a predetermined angular magnitude;

a first cam provided on said shaft;

a first coupling means for coupling said first cam to said discharge roller means;

a second cam provided on said shaft; and, a second coupling means for coupling said second cam to said support member, wherein upon rotating said shaft the predetermined angular magnitude, said first cam causes the movement of the discharge roller means between said retracted position out of contact with said notes and said extended discharge position in contact with said notes, and said second cam causes the movement of the support member between said retracted position away from said discharge roller means and said extended discharge position.

7. The bank note depositing device of claim 6 wherein said first coupling means comprises a link, one end of which contains an opening operatively coupled to said first cam and the other end of which is connected to said discharge roller means.

8. The bank note depositing device of claim 6 wherein said second coupling means comprises a movable plate means for moving said support member between said retracted position away from said discharge roller means and said extended discharge position, said movable plate means containing an opening in its surface for receiving said second cam.

9. The bank note depositing device of claim 3 further comprising:

an intermittent clutch means having a shaft connected thereto for rotating said shaft a predetermined angular magnitude;

a cam provided on said shaft; and, a coupling means for coupling said cam to said door member, wherein upon rotating said shaft said predetermined angular magnitude, said cam causes the movement of said door member between said first position closing said outlet, and said second position opening said outlet for permitting said notes to be discharged from said storing means.

10. The bank note depositing device of claim 9 wherein said coupling means comprises a link, one end of which contains an opening operatively coupled to said cam and the other end of which is connected to said door member.

11. A bank note depositing device for a transaction machine comprising:

a cabinet having a depositing inlet through which at least one bank note is deposited into said transaction machine;

a storing means positioned within said cabinet and adjacent said depositing inlet for temporarily storing a plurality of bank notes simultaneously entering said machine through said depositing inlet, said storing means having an outlet through which said notes are discharged;

a discharge roller means for discharging the note from said storing means, said discharge roller means movable between a retracted position out of said storing means and out of contact with said notes and an extended discharging position within said storing means and in contact with said notes; and, a support member positioned opposite said roller means on the opposite side of said notes, said support member movable between a retracted position within said storing means and away from said discharge roller means and an extended discharge position within said storing means and toward said roller means to urge said notes into contact with said roller means.

12. The bank note depositing device of claim 11 further comprising: a closure means positioned adjacent said outlet for opening and closing said outlet.

13. The bank note depositing device of claim 11 further comprising a detecting means for detecting the presence of an excessive amount of bank notes within said storing means.

* * * * *